US009380920B2

(12) United States Patent
Pollack

(10) Patent No.: US 9,380,920 B2
(45) Date of Patent: Jul. 5, 2016

(54) OZONE INJECTION FOR CONTINUOUS FLOW CLEANING SYSTEMS

(75) Inventor: Jeffrey W. Pollack, Joliet (IL)

(73) Assignee: Minuteman International, Inc., Hampshire, IL (US)

( * ) Notice: Subject to any disclaimer, the term of this patent is extended or adjusted under 35 U.S.C. 154(b) by 1171 days.

(21) Appl. No.: 13/317,424

(22) Filed: Oct. 18, 2011

(65) Prior Publication Data

US 2013/0091653 A1 Apr. 18, 2013

(51) Int. Cl.
*A47L 11/26* (2006.01)
*A47L 11/283* (2006.01)
*A47L 11/40* (2006.01)

(52) U.S. Cl.
CPC ..... *A47L 11/283* (2013.01); *A47L 11/4083* (2013.01)

(58) Field of Classification Search
CPC ..... A47L 11/283; A47L 11/4083
USPC ..... 15/320
IPC ..... A47L 11/26
See application file for complete search history.

(56) References Cited

U.S. PATENT DOCUMENTS

| | | | | |
|---|---|---|---|---|
| 5,326,444 | A * | 7/1994 | Nakamatsu et al. | 204/265 |
| 5,454,922 | A * | 10/1995 | Joshi et al. | 204/265 |
| 5,493,754 | A | 2/1996 | Gurstein et al. | |
| 5,815,869 | A * | 10/1998 | Hopkins | 8/158 |
| 5,839,155 | A * | 11/1998 | Berglund et al. | 15/321 |
| 5,946,769 | A * | 9/1999 | Sprinkle | 15/321 |
| 7,836,543 | B2 * | 11/2010 | Field et al. | 15/320 |
| 2002/0112314 | A1 * | 8/2002 | Harkins | 15/321 |
| 2006/0027212 | A1 * | 2/2006 | Gardner et al. | 123/458 |
| 2011/0011736 | A1 * | 1/2011 | Yost et al. | 204/263 |
| 2012/0168302 | A1 * | 7/2012 | Kato et al. | 204/266 |
| 2013/0206704 | A1 * | 8/2013 | Hengsperger et al. | 210/748.19 |

* cited by examiner

*Primary Examiner* — David Redding
(74) *Attorney, Agent, or Firm* — Greer, Burns & Crain, Ltd.

(57) ABSTRACT

A mobile floor cleaning machine has a clean water system with a reservoir for applying water to a floor during cleaning. The floor cleaning machine includes an ozone source which generates ozone in liquid form and introduces the liquid ozone directly into the circulating water for eliminating pathogens in the circulating water. The ozone is generated continuously and essentially instantaneously by the ozone source and destroys most bacteria, virus, fungus and mold in the circulating water at room temperature, while decaying harmlessly to oxygen within the water and producing fewer by-products than chemical sanitizers and having essentially no environmental impact.

6 Claims, 8 Drawing Sheets

OZONE INJECTION FOR CONTINUOUS FLOW CLEANING SYSTEMS

FIELD OF THE INVENTION

This invention relates generally to mobile floor cleaning machines and is particularly directed to a self-contained arrangement for continuously purifying the circulating water used to clean a floor during on-the-go operation of the floor cleaning machine.

BACKGROUND OF THE INVENTION

Ozone is a highly reactive substance which naturally occurs as a gas comprised of three bonded oxygen atoms. Common uses of ozone include the treatment of drinking and swimming pool water, the treatment of industrial waste, the bleaching of inorganic products such as clay, and as a disinfectant. Ozone is formed by breaking apart diatomic oxygen molecules, with the free oxygen atoms thus produced reacting with conventional diatomic oxygen molecules to form ozone. In the past, two methods have been used to produce ozone for commercial purposes. These two methods involve ultraviolet (UV) radiation and corona discharge. Ultraviolet ozone generation has been used primarily in air ducts and for the preservation of food and is a relatively inefficient source of ozone.

Corona discharge is on the order of 2½ times as efficient as ultraviolet light in terms of energy required to produce a corresponding amount of ozone and has been used to provide greater quantities and higher concentrations of ozone than UV light. Ozone is produced by corona discharge by positioning two parallel metal plate electrodes in relatively closely spaced relation and passing a high voltage alternating current through the two electrodes. Electrons traveling between the two electrodes collide with oxygen in the atmosphere to break apart the diatomic oxygen molecules, with the thus freed individual oxygen molecules reacting with the diatomic oxygen molecules to produce ozone. Although more energy efficient than the UV radiation approach to producing ozone, the corona discharge approach is also a relatively inefficient source of ozone and requires extensive safety provisions and complex installations because of the high voltages involved in this approach for ozone production.

Ozone has been used in several applications to promote clean air and improve the atmosphere. For example, an ozonizer is disclosed as positioned in an exhaust duct of a vacuum cleaner to purify the exhaust air of the vacuum cleaner in U.S. Pat. No. 5,185,903. One problem that this approach arises from the propensity of ozone to act as a strong irritant causing discomfort to the eyes and throats of those in the vicinity of the ozone source. Higher concentrations of ozone are also believed to affect mental awareness and general health.

Ozone is also disclosed for use in a circulating liquid cleaning solution for cleaning, sanitizing and deodorizing the application area in U.S. Pat. No. 7,302,733. However, in this approach, ozone is introduced in a gaseous state, with some of the ozone dissolved in the liquid cleaning solution, while some of the ozone remains in the gaseous state. Thus, this approach directly introduces ozone into the air and requires a carbon filter or an ultraviolet energy source in its exhaust system to limit the ozone concentration of its emissions. In addition, this approach uses the relatively inefficient approach of ultraviolet light generation of ozone which, as discussed above, is much less energy efficient than even the corona discharge approach to ozone generation.

The present invention addresses the problems encountered in the prior art in the generation and use of ozone in mobile cleaning machines to provide a safe and economical approach to purifying the water in a mobile floor cleaning machine.

OBJECTS AND SUMMARY OF THE INVENTION

Accordingly, it is an object of the present invention to continuously provide clean water in a self-contained manner for cleaning floors in a mobile floor cleaning machine.

It is another object of the present invention to more efficiently clean with a mobile floor cleaning machine using a compact, self-contained, environmentally clean, economical, safe and energy efficient water purification system.

It is yet another object of the present invention to use liquid ozone which is introduced directly into a circulating cleaning solution in a mobile cleaning machine for cleaning virtually any type of floor in a safe and economical manner.

A further object of the present invention is to use ozone in liquid form to maintain a cleaning solution circulating in a closed system in a highly purified state by generating the ozone at its point of use to accommodate ozone's short half life, provide high efficiency of the ozone introduced into the cleaning solution, and avoid the technical and environmental challenges associated with ozone in the gaseous state.

The present invention contemplates a floor cleaning machine comprising a vacuum nozzle located at a forward portion of the floor cleaning machine and adapted for suctioning material on a floor in front of the floor cleaning machine; a liquid cleaning solution reservoir; a floor scrubbing assembly including a scrub member disposed aft of the vacuum nozzle and including a contact portion adapted to contact the surface of a floor to be cleaned; a motor coupled to the scrub member for moving the scrub member into contact against the floor for scrubbing the floor; a fluid conveying system coupled to the liquid cleaning solution reservoir and to the scrub member for providing cleaning solution to the scrub member and further coupled to the vacuum nozzle for returning the cleaning fluid to the cleaning solution reservoir following use on the floor; and an ozone cell coupled to the fluid conveying system for injecting liquid ozone into the liquid cleaning solution for eliminating pathogens in the cleaning solution.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
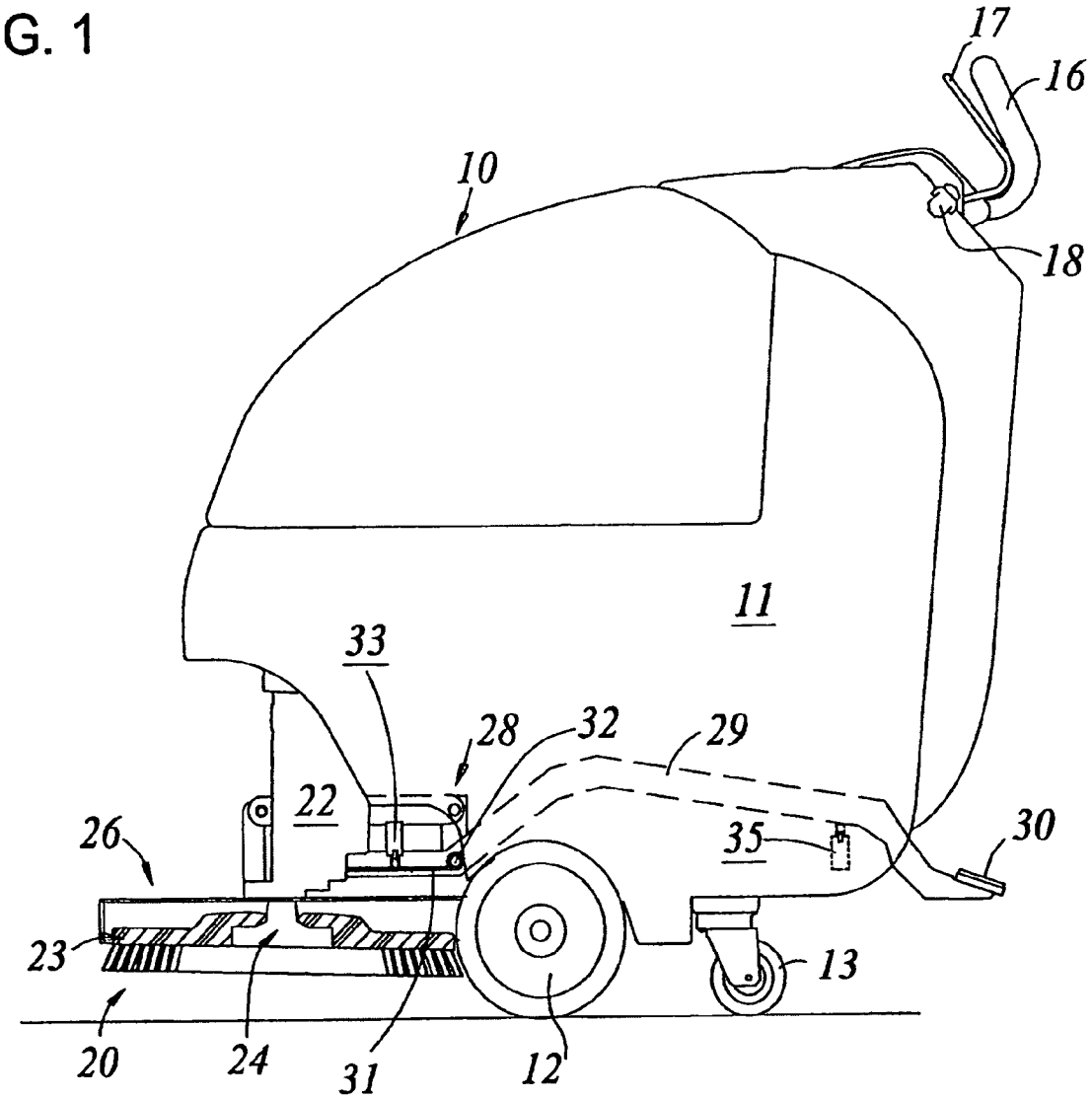
FIG. 1 is a side view of a floor scrubbing machine for carrying out the present invention, but otherwise simplified, with the brush shown in vertical cross section, and with the brush in the raised or transport position.

Referring first to FIG. 1, reference numeral 10 generally designates a typical floor scrubbing machine for carrying out the present invention. The machine includes an outer housing or casing 11 and is supported by forward wheels 12, as well as two rear caster wheels 13. Some machines may only employ two wheels such as a carpet extractor. In addition, this invention can be used on very hard floors such as of hardwood, tile, concrete, etc., as well as on soft surfaces such as of plush carpeting or other soft material and can also be used on a wide range of floor textures.

Within the housing 11 are batteries for powering the machine, a reservoir of cleaning fluid for application to the scrub brush or directly to the floor, with a rear suction device for recovering spent solution and a storage tank for tile spent solution, all of which are conventional and not shown in detail. While the floor scrubbing machine in the described embodiment is powered by batteries, it could equally as well be powered by an AC voltage source. However, this latter embodiment is not described for the sake of brevity and simplicity, as the cleaning machine could easily be adapted for AC operation by one skilled in the art.

An operator's handle 16 is rigidly mounted to the frame permitting the operator to maneuver the machine. Forward of the handle 16 is an actuator 17, controlled by the operator, which closes an Operator Run switch 17A (See the schematic of FIG. 6) when actuated. Actuator 17 may be a manually operated bail adjacent the operator's hand, and pivotally connected to the machine so that the operator can simply squeeze the pivoting actuator handle 17 toward the fixed handle 16 to actuate the Operator Run switch (to be further described within) and power the scrub brush in the lowered position of FIG. 2.

Figure 6:
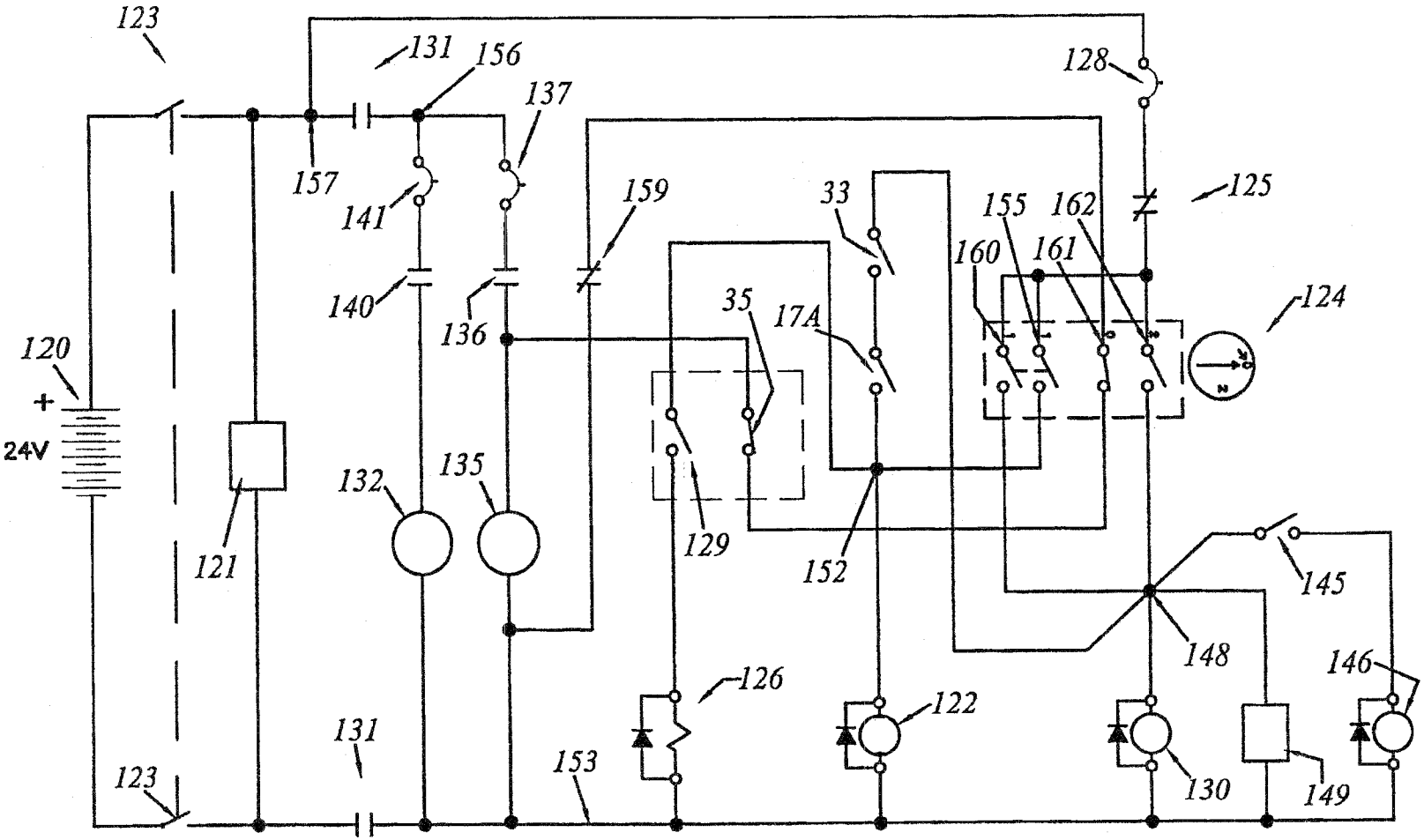
FIG. 6 is a circuit schematic diagram of the electrical control circuit for the machine of FIG. 1 in the Transport Mode.
Figure 7:
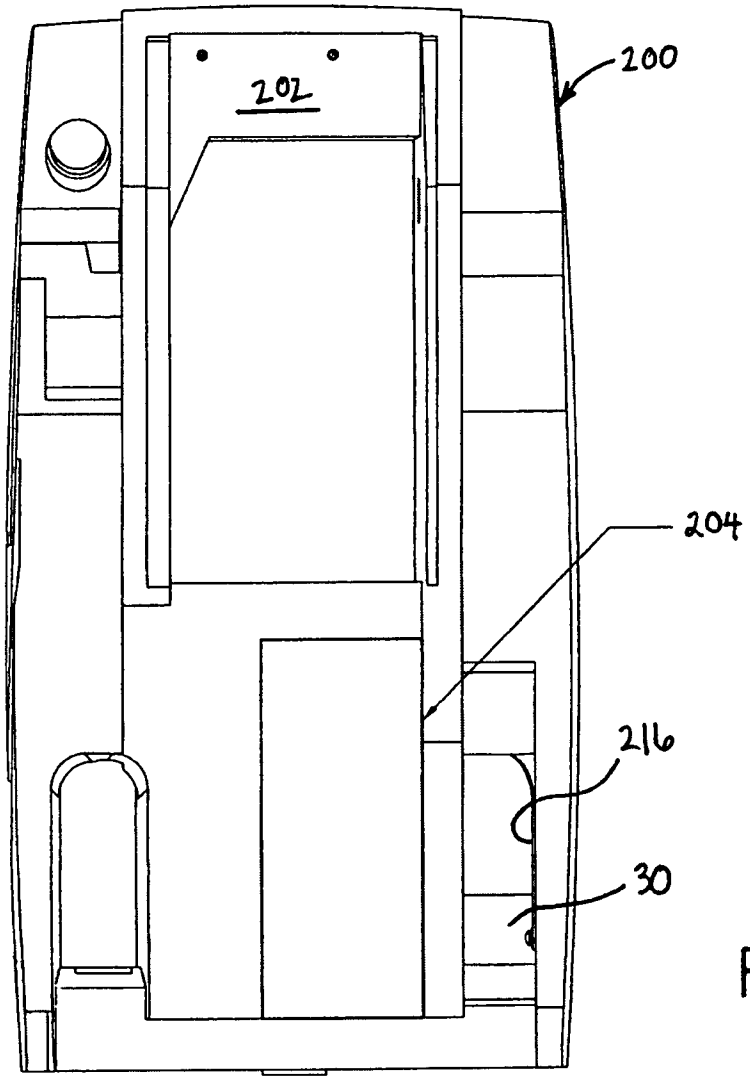
FIG. 7 is an elevation view of the rear panel of a mobile floor cleaning machine for use in carrying out the present invention.

Also mounted on the operator's console, adjacent the handle 16 (so as to be conveniently accessible to the operator) is a Keyswitch 18 (diagrammatically shown and designated 124 in the electrical schematic, FIG. 6), which is a rotary switch temporarily actuated by a key and biased to an "off position, to be described further within. It will be appreciated, however, that the Keyswitch 18 is readily accessible to the operator when he or she is positioned at the operator's station behind the machine (to the right in FIG. 1).

Turning now to the lower forward portion of the machine, a scrub brush generally designated 20, is mounted to a drive shaft connected to a motor 22. At the lower end of the drive shaft (designated 34 in FIG. 3) there is mounted a hub assembly generally designated 24. The motor 22 is mounted above a deck 26 which houses the brush 20. The motor and deck are carried by the frame of the machine 10 by means of a lift linkage in the form of a four-bar or parallel linkage generally designated 28. A lever 29 provided with an actuating foot pedal 30 immediately in front of the operator's station is pivotally connected at 32 to the frame of the machine 10. The forward end of the lever 29 forms the lower link of the four bar linkage 28 so that when the operator depresses the foot pedal 30, the motor 22, brush 20 and deck 26 are lifted to the raised position shown in FIG. 1 for storage or transport.

Figure 2:
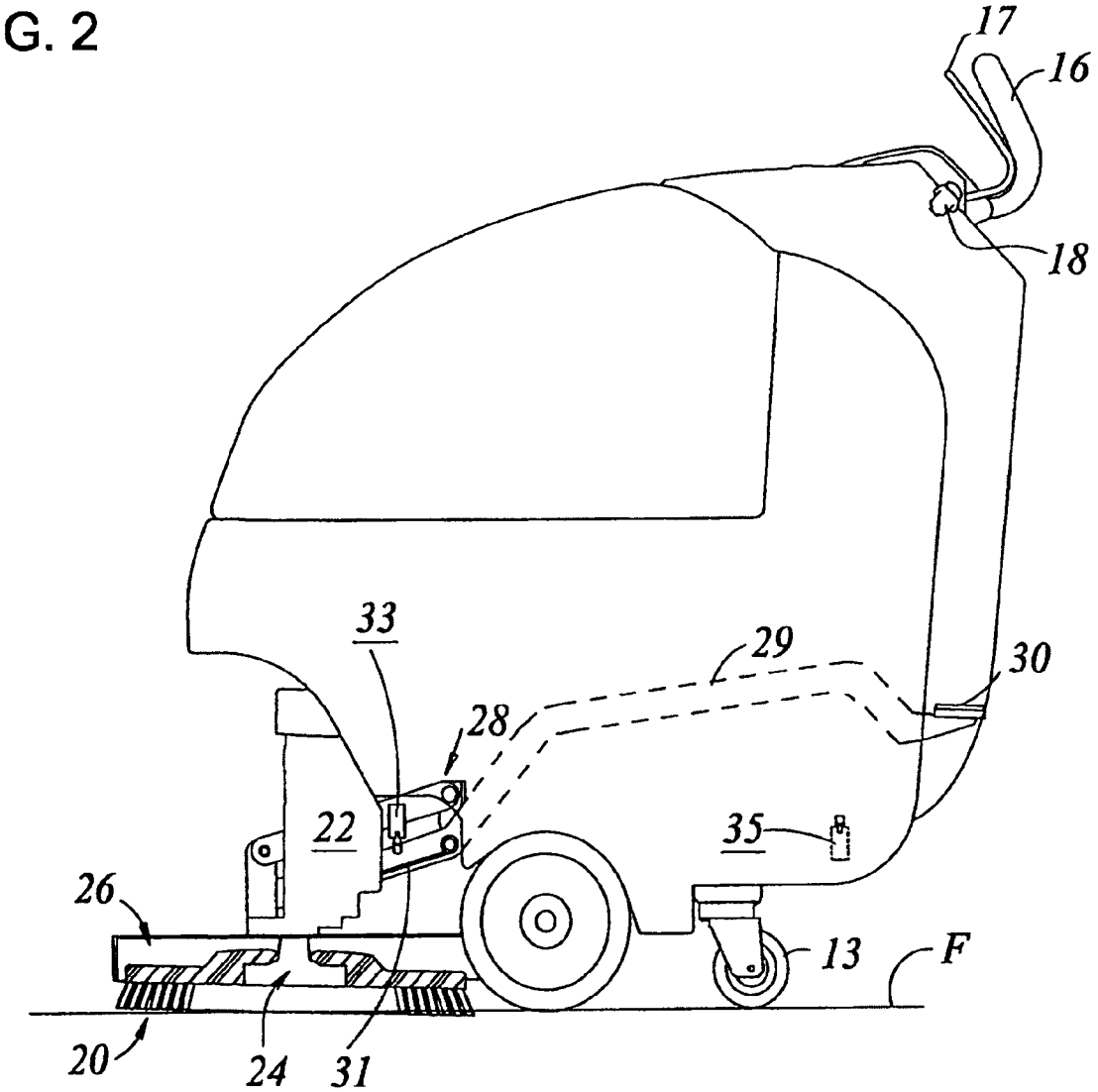
FIG. 2 is a view similar to FIG. 1, with the brush in the lowered or use position.

When the foot pedal 30 is released as seen in FIG. 2, the motor and brush are lowered by the four-bar linkage 28 to the operating position, with the bristles of the brush contacting the floor F (FIG. 2) for scrubbing. The mechanical aspects of the raise and lower mechanism, which permits the brush to be set in the biased position indefinitely, are conventional.

A Run Enable switch 33 and Brush Unload Enable switch 35 may be mounted to the frame of the machine. The functions of these switches will be described in connection with the schematic diagram, FIG. 6. The Unload Enable switch 35 is actuated by lever 29 and Run Enable switch 33 is actuated by a strike plate designated 31 in FIGS. 1 and 2. The strike plate 31 is mounted to an extension of the lever 29 which extends forwardly of the pivot 32 and which forms the lower link of the parallel linkage 28. Briefly, the Run Enable switch allows the brush to be driven by the motor when the brush is lowered for use (FIG. 2), and the Brush Unload Enable switch allows the brush to be driven for unload when the brush is in the raised position (FIG. 1).

Figure 3:
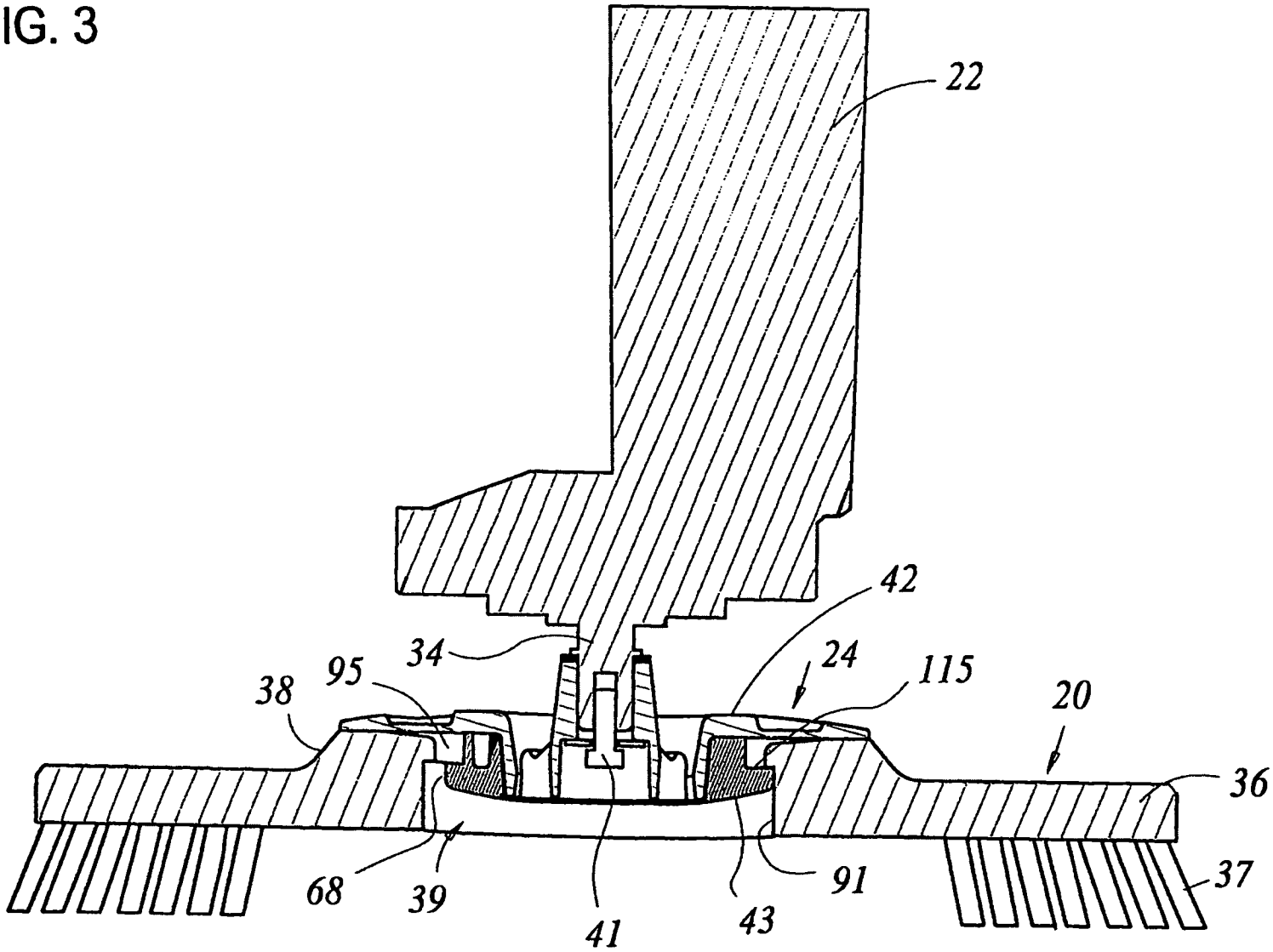
FIG. 3 is a vertical sectional view showing the motor, drive hub and brush in vertical cross section (along a plane through the axis of rotation of the brush extending in the direction of travel) and with the motor shown diagrammatically.

Turning now to FIG. 3, the motor 22 (and associated gearing, if any) is conventional and need not be described in further detail. The motor 22 drives a shaft 34 which extends in a vertical direction for driving the brush 20. The hub assembly 24 is connected to the drive shaft 34 and mounts the brush 20 as will be described in further detail.

The brush 20 includes a brush plate 36, the lower portion of which is provided with bristles 37. The center of the brush plate 36 is increased in thickness, as at 38, thus providing strength, and defining a receptacle generally designated 39 for receiving and releasably coupling to the hub assembly 24, as will be described in more detail within.

Figure 4:
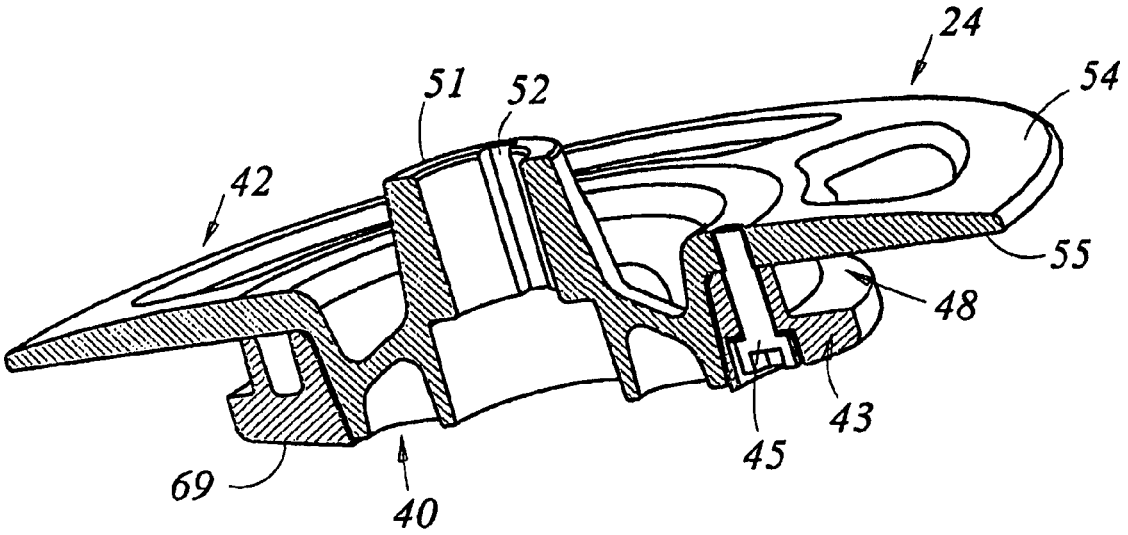
FIG. 4 is an upper perspective cross section view of the drive hub assembly.
Figure 5:
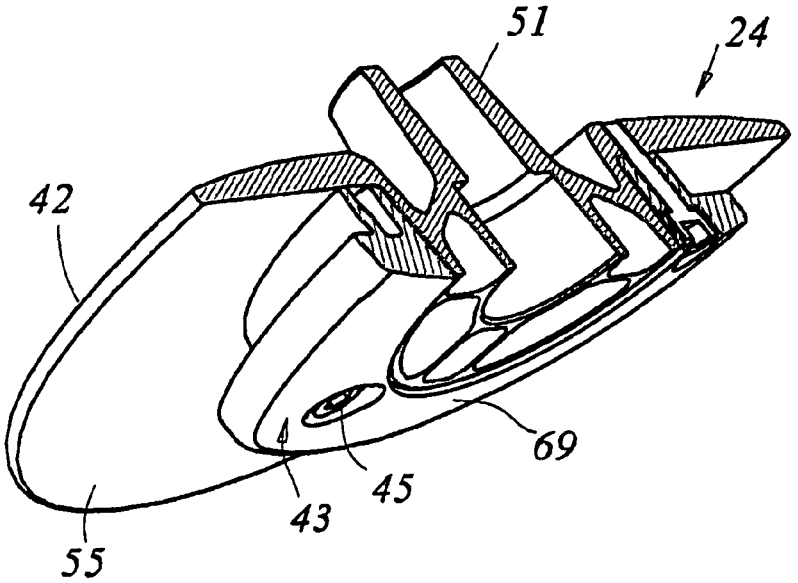
FIG. 5 is a view similar to FIG. 4, taken from a lower perspective of the drive hub.

Briefly, the hub assembly 24 includes an upper hub member 42, and a lower hub member (or "drive lug") 43. As will be described, the upper hub member 42 is placed respectively on the top of the central portion 38 of the brush 20, and the lower hub member 43 of the hub assembly 24 is located beneath the upper hub member and attached to it by means of bolts 45 (FIGS. 4 and 5). The hub assembly is fastened together by fasteners 45, and when fastened together, they grip and hold the brush plate 36 as seen in FIG. 3. The brush assembly is secure to the shaft 34 of the motor by fastener 41. As will be described, the upper hub member 24 applies the downward force on the brush 20, and the lower hub member or drive lug 43 is received in the lower, central receptacle 39 of the brush plate 36. The upper and lower hub members 42, 43 form the hub assembly 24; and they cooperate to provide an annular, circumferential retention groove or channel 48 for securing the brush 20 in the driving position of FIG. 3.

Turning now to FIGS. 4 and 5, there are shown, respectively, an upper perspective view and a lower perspective view of the drive hub assembly 24 in cross section. When the two hub members 42, 43 are secured together, by the fastener 45, they provide the retention groove or channel 48 for removably securing the brush.

Turning then to the upper hub member 42, it includes a central collar 51 which includes an axially extending key way 52 for coupling to the drive shaft 34 of the motor 22. The drive shaft 34 is provided with a matching keyway providing a driving engagement for the drive hub assembly when the upper and lower members are secured together as described above.

The upper hub member 42 also includes an outwardly extending circular flange 54 including a horizontally extending lower, generally flat lower surface 55 which extends horizontally when the hub assembly is connected to the drive shaft 34. The lower horizontal surface 55 of the upper hub member 42 rests on the upper cylindrical surface of the raised central portion 38 of the brush plate 36, and provides a means through which the upper hub member 42 exerts a downward force on the brush 20 when it is lowered to the operating position. The force may be provided by the weight of the motor 22 and the associated linkage assembly for positioning the drive motor. Additional force may be added by other means if necessary or desired.

Description of the Control Circuitry

Turning now to FIG. 6, there is shown an electrical schematic of the control circuit for operating the scrubber as has been described above. Reference numeral 120 generally designates a battery which supplies power to the unit. The battery 120 may be comprised of one or more deep cycle batteries. A battery charger 121 (operating normally-closed contacts 125) is connected across the terminals of the battery, to be plugged into a wall outlet when it is desired to charge the battery. When the battery charger is in operation, a first Keyswitch 124 is prevented from operating the system because contacts 125 open. A double-pole connector has two contacts 123, 123 connected respectively in the battery supply leads for manually disconnecting the battery for safety or testing of the circuit. Contacts 2 of first Keyswitch 124 (which is shown in electrical schematic form for switch 18 in FIG. 1, battery charger contact 125, and circuit breaker 128 are connected between junctions 157 and 148.

A brush relay designated 122 is connected in series with the normally-closed (i.e. when the brush is in the lowered position) Run Enable switch 33 and the normally-open Operator Run switch 17 A (shown in FIG. 6 in electrical schematic form). These three components are connected in a series circuit. One terminal of the Operator Run switch 17 A is connected to a junction 152. Two normally-open contacts 131, 131 of main relay 130 are connected respectively in the positive and negative battery leads. Keyswitch 124, which enables the operator to turn the system "on" or "off" and provides security, is connected as shown. First Keyswitch 124 is a spring biased, multiple contact switch. Briefly, switch 162 of first Keyswitch 124 is connected between junction 148 and the battery supply. Switch 161 is connected in series with normally-closed Unload Enable switch 35; switch 160 is connected to junction 148, and switch 155 (which operated with switch 160) is connected to junction 152. Contacts 125 of an internal relay of battery charger 121 are connected in series with a circuit breaker 128 and first Keyswitch 124. A main relay 130 is connected between junction 148 and battery negative. First Keyswitch 124 has three positions: Off (designated 0); On (designated 2); and Brush Unload (designated I in the drawing). When the contact (which is actuated by turning the key) moves to the numbered position, the similarly numbered contacts are actuated, as will be further described. In the Brush Unload position, first Keyswitch 124 is spring-biased to the off position and returns if released by the operator.

The upper set of normally-open contacts 131 of the main relay 130 couple power, when closed, to a junction 156. A vacuum switch 145 is connected between junction 148 and a vacuum relay 146, thus energizing a vacuum motor 132 when switch 145 is closed by the operator and junction 148 is energized.

In series with the circuit containing the brush motor 135 are normally-open contacts 136 actuated by a brush relay 122. A circuit breaker 137 is connected in series with the normally-open contacts 136. For reasons which will become clear, the terminals of brush motor 135 are shown as terminals 138 and 139 (which is connected to the battery negative supply line 153 when the system is in operation).

Normally-open contacts 140 (actuated by the vacuum relay 146) are connected in circuit with a circuit breaker 141 and a vacuum motor 132 for actuating the vacuum recovery system.

A vacuum switch 145, normally closed, is connected in series with the vacuum relay 146, this circuit being connected to the junction 148, as seen. A battery gauge 149 is also connected to the junction 148.

Turning to the right side of FIG. 6, the previously described Operator Run switch 17A, (bail-operated and having normally-open contacts) is connected in series with the normally-closed contacts of the Run Enable switch 33. The Run Enable switch 33 is actuated to the closed position by the strike plate 31 being in the lowered position, as seen in FIG. 2. When the Run Enable switch 33 is closed (the strike plate 31 being lowered with the brush by action of the operator), the operator may then operate the machine by actuating (via the bail 17) the Operator Run switch 17A. Junction 152 is a common junction for switch 155 of the first Keyswitch 124, the circuit comprising the Run Enable switch 33 and the Operator Run switch 17A just described; the brush relay 122; and a series circuit comprising a water solenoid switch 129 and solenoid 126 for opening a valve to the water supply when switch 129 is closed by the operator's release of foot pedal 30.

The first Keyswitch 124 includes a set of normally-open contacts 155 which are connected to the junction 152. Normally-closed contacts 161 of the first Keyswitch 124 are connected in circuit with the normally-open Unload Enable switch 35 (shown in FIG. 6 in the closed position because FIG. 6 represents the system in the Transport Mode) which is connected to brush motor terminal 138, and normally-closed contacts 159 of the brush relay 122, which are connected to brush motor terminal 139.

Operation of the Circuitry

Normal Running Operation

The electrical schematic of FIG. 6 is shown in the transport mode. Thus, for example, the normally closed Run Enable switch 33 is shown as open in FIG. 6 and normally open Unload Enable switch 35 is shown as closed. Assuming the battery 120 is connected (switches 123 closed), when a key is inserted in first Keyswitch 124 and turned by the operator to position "2", switch 162 closes, and the battery 120 is connected through the circuit breaker 128, normally-closed contacts 125 of battery charger 121 (since battery charger 121 is not in operation) and contacts 162 of the Keyswitch 124 to the junction 148. This operates the battery gauge 149 for operator observation, and it also actuates the main relay 130.

When the main relay 130 is energized, contacts 131, 131 close, supplying power to modes 153 and 156. If the vacuum switch 145 is closed (manually), the vacuum relay 146 is energized, thereby closing the contacts 140 and energizing the vacuum motor (i.e., pump) 132.

Assuming that the brush is in the lowered or operating position, the Run Enable switch 33 is closed. This then couples power from junction 148 through the Run Enable switch 33 and the Operator Run switch 17A (when bail or actuator 17 is moved by the operator) to the junction 152. This actuates the brush relay 122 which, in turn, closes contacts 136 to energize the brush motor 135 to drive the brush 20. At the same time, the water solenoid 125 (optional) may be energized to supply water to the brush 20 because switch 129 is normally closed.

Operation continues until the operator releases the bail handle 17 which then opens the Operator Run switch 17A, thereby opening the contacts of switch 17A in FIG. 6 to de-energize the brush relay 122 and thereby, de-energize the brush motor 135.

Transport and Brush Unload

For transport, storage or brush unload (to clean, store or charge, for example), the foot pedal 30 is depressed by the operator. This raises the brush 20 to the raised position shown in FIG. 2, and the control circuit is as shown in FIG. 6. To unload the brush, the operator turns the first Keyswitch 124 to position "1", which is spring biased to return to the "OFF" or "0" position when the key is released.

When the key is in position "1", contacts 160 and 155 are closed. Contacts 155 cause the brush relay 122 to be energized via junction 152. This closes contacts 136 to energize the brush motor 135 which drives the brush in rotation (in the raised position). When the brush reaches normal speed (or even less), the operator releases the key, and the Keyswitch reverts under spring bias to position "0". In this position, contacts 155 and 160 open and contacts 161 close. This action shorts out the terminals 138, 139 of brush motor 135 via the circuit comprising: terminal 138, Unload Enable switch 35 (actuated to the closed position by virtue of manually raising the brush); closed contacts 161 (switch position "0"); and brush relay contacts 159 to motor terminal 139.

If it is desired to remove the brush the operator depresses the foot pedal 30, elevating the brush to the raised position which, in turn, closes the Unload Enable switch 35. This opens contacts 33 and closes contacts 35 of the Unload Enable switch, thereby permitting a brush removal because the brush is raised.

When the circuit is in this condition, if the operator rotates the Keyswitch 124 to the "Brush Unload" position, the contacts 155 and 160 close. This causes the main relay 130 and brush relay 122 to be momentarily energized, thereby enabling the brush motor 135 to be energized through contacts 136 (contacts 161 being open). When the operator then releases the Keyswitch 124, it returns to position "0" under spring bias. Contacts 155 and 160 open, de-energizing the brush relay 122 and main relay 130 via junction 148, thereby opening contacts 136. At the same time, contacts 161 of the Keyswitch 124 are closed, as is the Unload Enable switch 35 by the operator, thereby placing a load to decelerate motor 135 and bringing the motor to a quick stop due to the load. This permits the brush to override the drive lug and be disengaged, and to fall freely from the brush drive assembly, or to be removed manually.

While various functions of the present invention are described as being carried out by control circuitry illustrated in FIG. 6, various of these functions could be carried out by proper programming of control circuitry located in controller 204 by one skilled in the art.

Figure 8:
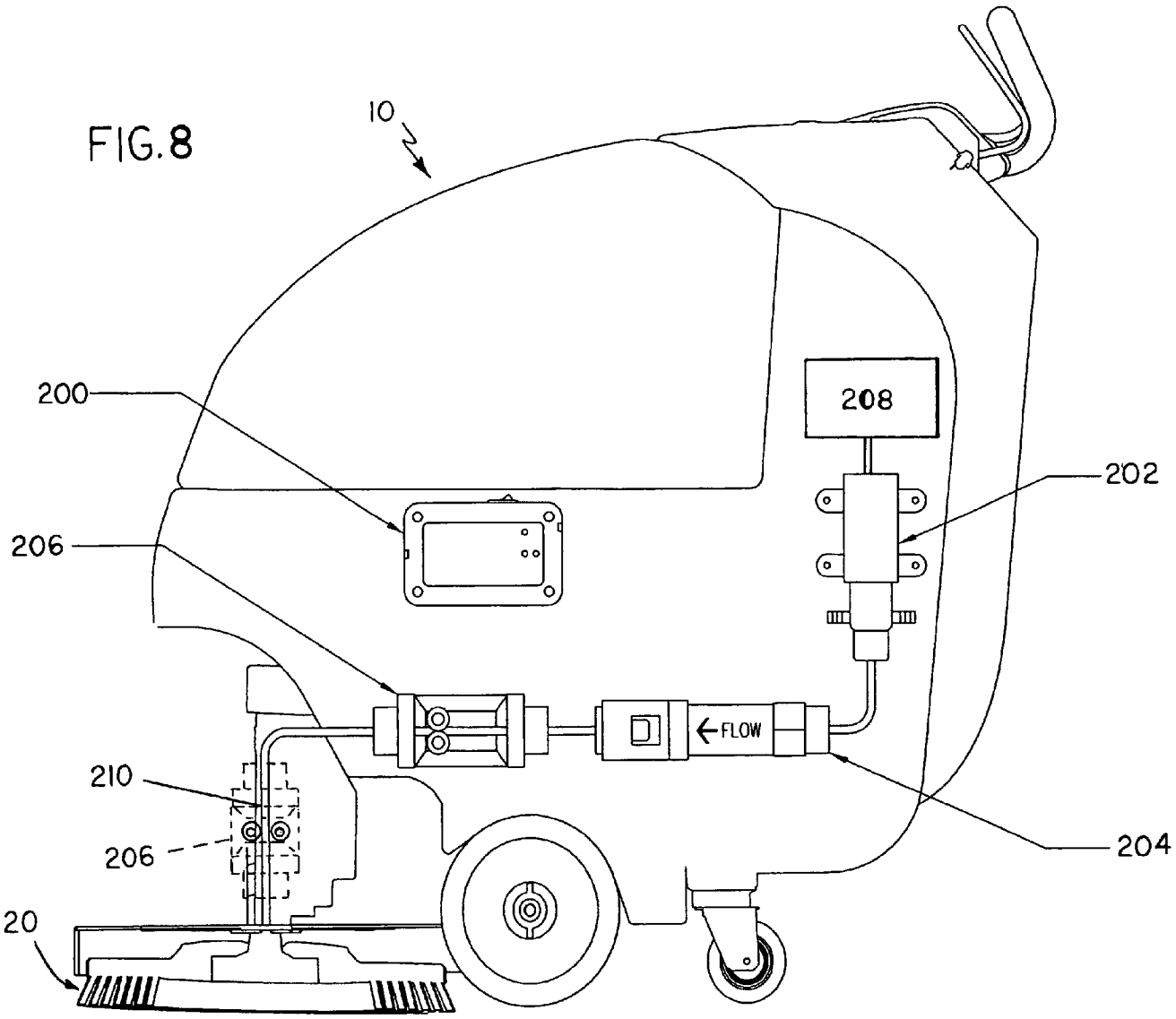
FIG. 8 is a simplified side elevation view of a floor cleaning machine in accordance with the principles of the present invention.

Referring to FIG. 8, there is shown a simplified side elevation view of a floor cleaning machine 10 in accordance with the present invention. In addition to the components described above, the inventive floor cleaning machine 10 further includes an ozone generator controller 200 and an ozone cell 206 capable of generating ozone in liquid form. Floor cleaning machine 10 further includes a clean water reservoir 208 which provides clean water to a cleaning solution pump 202. Cleaning solution pump 202 is connected to and provides cleaning solution to the ozone cell 206 via a flow sensor 204. Ozone cell 206 is connected to rotating brush 20 by means of a conduit 210 for providing a mixture of the cleaning solution and ozone liquid to the brush for cleaning a floor surface. Ozone generator controller 200 is coupled to ozone cell 206 as well as to flow sensor 204. Ozone generator controller 200 provides input power to and control for the ozone cell 206. Cleaning solution pump 202 receives clean water from reservoir 208 and pumps the clean water to the flow sensor 204. Flow sensor 204 is in communication with the ozone generator controller 200 and provides cleaning solution flow information to the ozone generator controller. In response to inputs from flow sensor 204, ozone generator controller 200 initiates operation of the ozone cell 206 upon the detection of cleaning fluid flow by flow sensor and maintains operation of the ozone cell so long as there is a detectable flow of the cleaning solution. When the cleaning solution pump 202 is turned off, flow sensor 204 provides an appropriate signal to ozone generator controller 200, whereupon the ozone generator controller provides an output signal to the ozone cell 206 terminating operation of the ozone cell and the flow of ozone in the system. It should be noted that in some systems cleaning solution may flow under the influence of gravity and the cleaning solution pump 202 may not be needed in such systems. In addition, flow sensor 204 may also not be needed in some mobile cleaning machines as there are other available conventional approaches well known to those skilled in the relevant art to detect the flow of a first solution and exercise control over the flow of a second solution. The ozone cell 206 may be installed at various locations in the water circulating system such as immediately adjacent the brush 20 as shown in dotted line form in FIG. 8.

Figure 9:
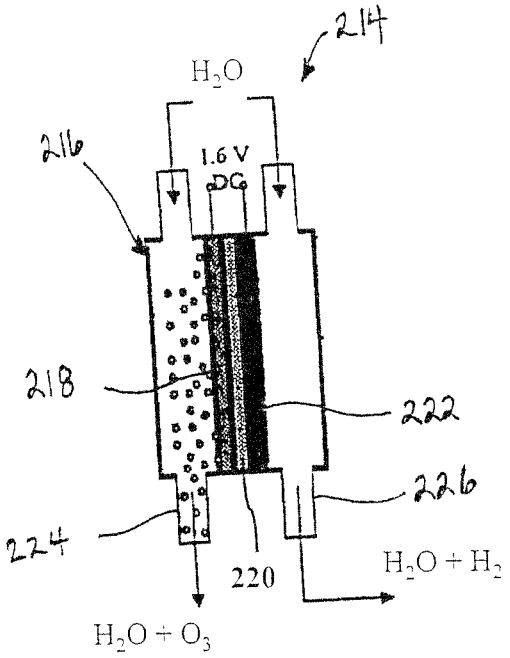
FIG. 9 is a simplified sectional view of an ozone cell for use in the present invention.

Referring to FIG. 9, there is shown a simplified sectional view of an ozone cell 214 for use in the present invention. Ozone cell 214 includes a housing 216 containing an anode 218, a cathode 222 and an ion permeable membrane 220. Anode is preferably comprised of $PbO_2$, Pt or boron-doped diamond. Cathode is preferably comprised of Pt or diamond. A DC voltage is applied across anode 218 and cathode 222 at a value on the order of 1.6 VDC. Water is directed into two inlets within housing 216 so as to create one flow channel over an outer surface of anode 218 and a second flow channel across the outer surface of cathode 222. The combination of water and ozone exits housing 216 via a first outlet 224, while water and hydrogen is discharged from a second outlet 226 of the housing. One example of an ozone cell which could be used in the present invention is available from Electrolytic Ozone, Inc., which is currently located in the Boston, Mass. area.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the claims when viewed in their proper perspective based on the prior art.

What is claimed is:

1. A floor cleaning machine comprising:

a spray nozzle located at a forward portion of the floor cleaning machine or thereabouts;

a liquid cleaning solution reservoir;

a floor scrubbing assembly including a scrub member disposed aft of said spray nozzle and including a contact portion adapted to contact the surface of a floor to be cleaned;

a motor coupled to said scrub member for moving said scrub member into contact against said floor for scrubbing said floor;

a fluid conveying system including a cleaning solution flow sensor and coupled to said liquid cleaning solution reservoir and to said scrub member for providing cleaning solution to said scrub member;

an ozone cell coupled to said fluid conveying system for injecting liquid ozone into the liquid cleaning solution for eliminating pathogens in the cleaning solution, wherein said ozone cell receives water and generates ozone directly in the water; and a controller coupled to said cleaning solution flow sensor and to said ozone cell for initiating ozone discharge into the cleaning solution upon detection of cleaning solution flow and terminating ozone discharge when cleaning fluid flow stops.

2. The floor cleaning machine of claim 1 wherein said ozone cell is located adjacent to where said fluid conveying system is coupled to said scrub member.

3. The floor cleaning machine of claim 1 further comprising a cleaning solution pump coupled to said fluid conveying system for directing the cleaning solution to said ozone cell.

4. The floor cleaning machine of claim 1 wherein said ozone cell includes an anode and a cathode maintained at a difference in DC voltage and separated by an ion permeable membrane.

5. The floor cleaning machine of claim 4 wherein said anode is comprised of $PbO_2$, Pt or boron-doped diamond and said cathode is comprised of Pt or diamond.

6. The floor cleaning machine of claim 5 wherein ozone, water and hydrogen are generated by said ozone cell.

* * * * *